United States Patent [19]

Ellingson

[11] 4,012,878

[45] Mar. 22, 1977

[54] UNITARY WALL MEMBER GUARD

[75] Inventor: Robert T. Ellingson, Burnsville, Minn.

[73] Assignee: Astro Plastics, Inc., Rosemount, Minn.

[22] Filed: Apr. 14, 1976

[21] Appl. No.: 677,042

[52] U.S. Cl. ..... 52/288; 52/716; 52/254; 248/345.1

[51] Int. Cl.[2] ..... E04B 5/00; E04F 13/06; E04B 7/00; E04F 19/02

[58] Field of Search ..... 52/716–718, 52/254–256, 288; 248/345.1

[56] References Cited

UNITED STATES PATENTS

| | | | |
|---|---|---|---|
| 3,559,356 | 2/1971 | Koral | 248/345.1 |
| 3,717,968 | 2/1973 | Olsen | 52/718 |
| 3,934,385 | 1/1976 | Paulus et al. | 52/716 |

FOREIGN PATENTS OR APPLICATIONS

| | | | |
|---|---|---|---|
| 110,186 | 1/1970 | Denmark | 52/290 |

*Primary Examiner*—Price C. Faw, Jr.
*Assistant Examiner*—James L. Ridgill, Jr.
*Attorney, Agent, or Firm*—Leo Gregory

[57] ABSTRACT

A unitary protective wall member guard such as for a corner consisting of an underlying layer conforming to the wall member and a second overlying layer spaced from said first layer there across for a substantial extent thereof and said layers having common side edge portions, said second layer being in spaced relation to said wall member, being yieldingly resistant to impact, saving the underlying corner member from the direct effect of the impact and distributing the impact throughout the extent of itself.

4 Claims, 6 Drawing Figures

UNITARY WALL MEMBER GUARD

BACKGROUND AND SUMMARY OF THE INVENTION

This invention relates to a unitary protective wall member guard such as to protect corners which are subject to being demaged by impact such as from various vehicles wheeled about as through hospital corridors.

Wall protective arrangements are well known in the art and commonly consist of a single layer of suitable material applied as to a wall corner surface. Also as indicated in U.S Pat. No. 3,717,968 to Robert W. Olsen et al and in U.S. Pat. No. 3,559,356 to Ephraim Koral, brackets are first applied and secured to the wall corner and bumper strips are carried by said brackets in spaced relation to wall corner surfaces.

The invention herein relates directly to a unitary protective guard structure having an underlying layer conforming to the protected wall surface and an overlying layer extending across said wall surface in spaced relation to said underlying layer and said layers having common side edge portions.

It is an object of the invention herein to provide a protective wall member guard having spaced layer portions to receive impact and distribute the same without having the effect thereof coming into direct contact with a protected wall surface.

It is another object of this invention herein to provide a protective guard as for a wall corner having spaced layers, the underlying layer conforming to the wall corner and the outer or overlying layer being spaced from said underlying layer substantially thereacross and said layers having common side edge portions and means securing said guard to said corner surface.

It is more specifically an object of the invention herein to provide a wall member protective guard having an underlying layer conforming to the wall member such as a corner and having spaced therefrom substantially thereacross an outer layer formed of such material as to resiliently yield to impact to distribute the effect of the impact without damage to the wall member, said layers having common side edge portions.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figure 1:
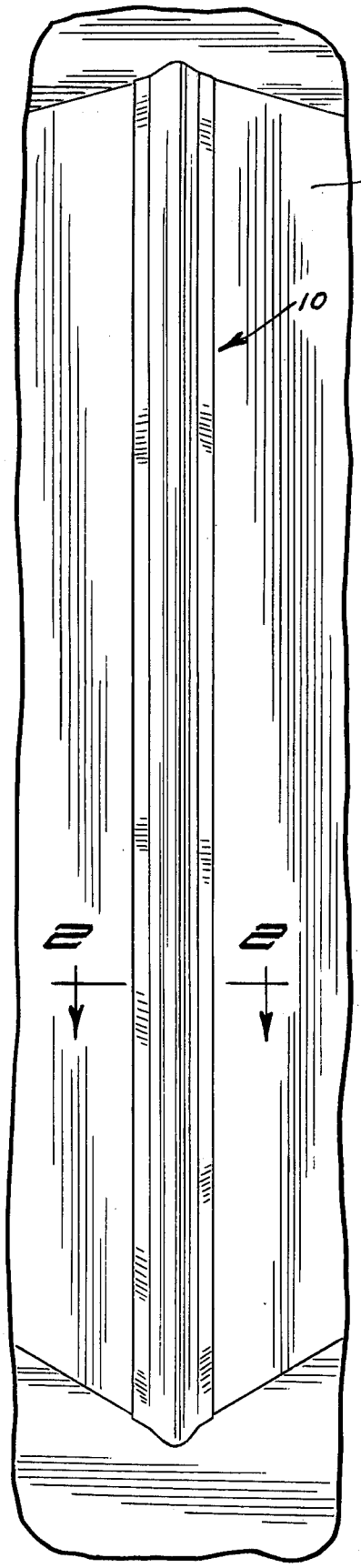
FIG. 1 is a view in elevation of a broken wall portion showing the invention herein in operating position.

Referring to the drawings, a wall guard member 10 comprising the invention herein is shown in operating position in FIG. 1. For purpose of illustration, guard member 10 is shown as a wall corner guard member.

Figure 2:
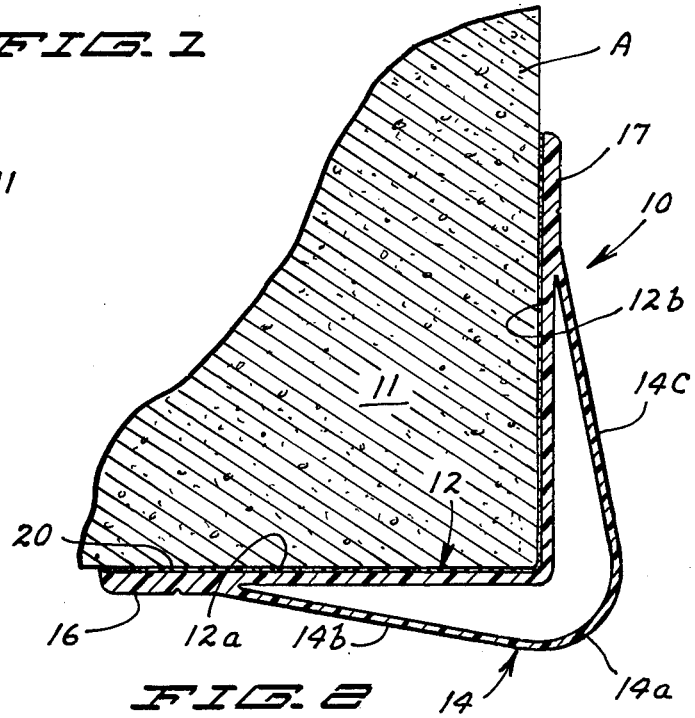
FIG. 2 is a view in horizontal section on an enlarged scale taken on line 2—2 of FIG. 1 as indicated.

With reference to FIG. 2, in this cross section view it is clearly shown that the corner guard member 10 is formed to be of a unitary construction an in being formed such as of a spring or resilient type of PVC it is readily extruded in this form. Hence the guard member as constructed lends itself to a relatively inexpensive manufacture.

The guard member 10 consists of an underlying layer 12 which conforms to the wall corner 11. Although the wall corner here is shown as being in the form of a right angle it will be understood that the wall corner may have other cross sectional configuration and said underlying layer 12 will be formed to conform thereto.

Overlying said layer 12 in spaced relation thereto substantially thereacross about said corner is an outer layer 14 which has its side portions **14*a* and 14*b* disposed at acute angled respectively to the sides 12*a* and 12*b* of said underlying layer whereby the side end portions of said underlying and said overlying layers merge to form common side edge portions 16 and 17**.

Figure 3:
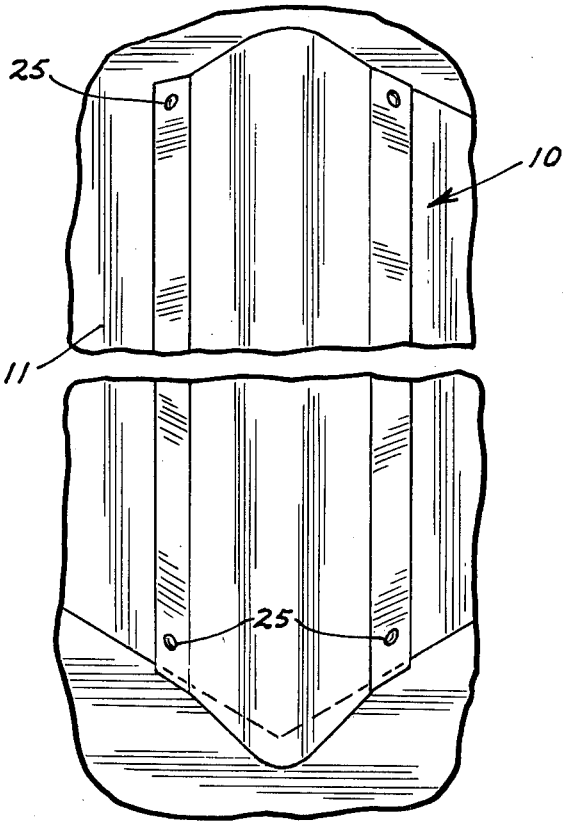
FIG. 3 is a broken view similar to FIG. 1 showing a modification.

The underlying surface of said layer 12 preferably will have a self-adhesive coating 20 applied thereto for a very simple and effective installation into operating position. However as indicated in FIG. 3, for additional holding effect, screws 25 may be applied as indicated.

It is fairly customary to have the protective guard member extend full wall height. However it may be desired to have said protective guard member of a shorter height as indicated by the strip 10' in FIG. 4. The strip 10' is of identical construction to the strip 10. To provide a finished appearance for a protective guard member of less than full wall height, a cap member 27 conforming to the horizontal cross sectional configuration of said strip 10 is applied thereon having an inner depending flange portion 28 as indicated in FIG. 5 extending inwardly of the space 29 formed between the inner and outer layers 12 and 14. Said cap strip may be secured as with the application of suitable adhesive.

Figure 6:
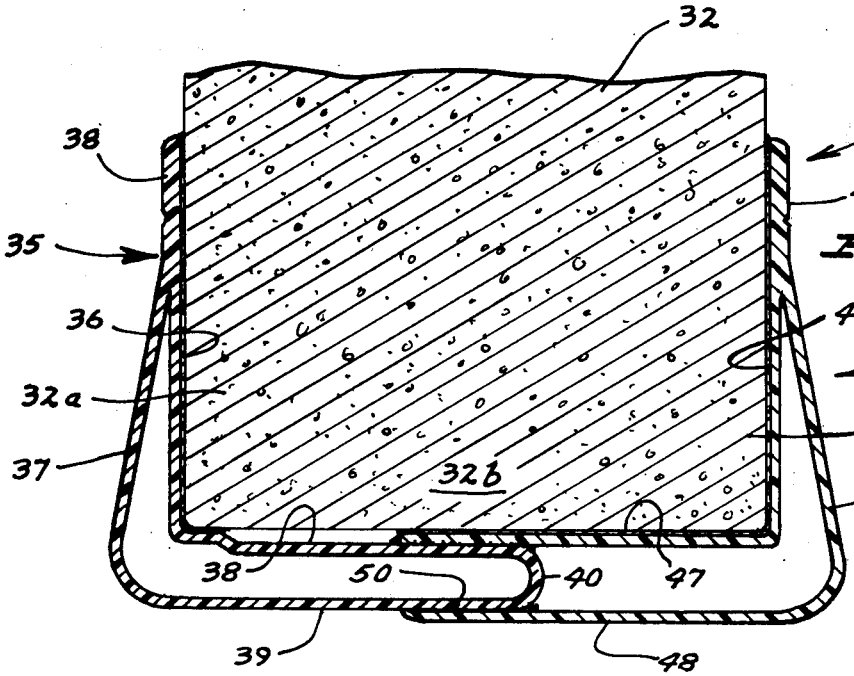
FIG. 6 is a view in horizontal section showing another modification.

A modification of said member 10 is shown in the form of the guard member 20 as illustrated in FIG. 6. Here the guard member is shown applied to extend about the end portion of a projecting wall 32 which is rectangular in cross section and the same may be formed as a dividing wall between adjacent recessed room entryways.

The guard member 30 comprises a portion 35 having an underlying layer 36 conforming to the angled portion **32*a* of said projecting wall and having an overlying layer 37 spaced outwardly therefrom about said angled portion 32*a*, said layers merge to form a common side edge portion 38**.

Said layers 36 and 37 have portions 38 and 39 extending about said corner **32*a* to overlie a portion of the front wall 32*b* of said projecting wall and are spaced in substantially parallel relation having a common end wall 40**.

The counter part to said portion 35 is the portion 41 having an underlying layer 43 conforming to the wall corner **32*c* and having an overlying layer 44 spaced outwardly therefrom, said layers merge to have a common side edge portion 45. The layer portions 47 and 48 of said inner and outer layers 43 and 44 overlie the front wall 32*c* in substantially parallel relationship to receive therebetween the end wall portion 40. The wall portion 38 is seen to be offset from said front wall 32*c* to provide space for said wall 47** to be disposed thereunder.

The overlapping wall portions 36, 47 and 37, 48 will be respectively secured together by a suitable adhesive to form a unitary construction.

With reference to the structure of FIGS. 1-5, the impact of any vehicle onto the outer layer 14 will cause said outer layer to deformably yield in a substantially lateral direction to distribute and dissipate the force of the impact. Said layer immediately restores itself to its original form. PVC is well known as a plastic material which can be very readily formed to have the spring like or resilient characteristic desired in the outer layer of the guard member and is very nicely extruded in the form desired.

Figure 4:
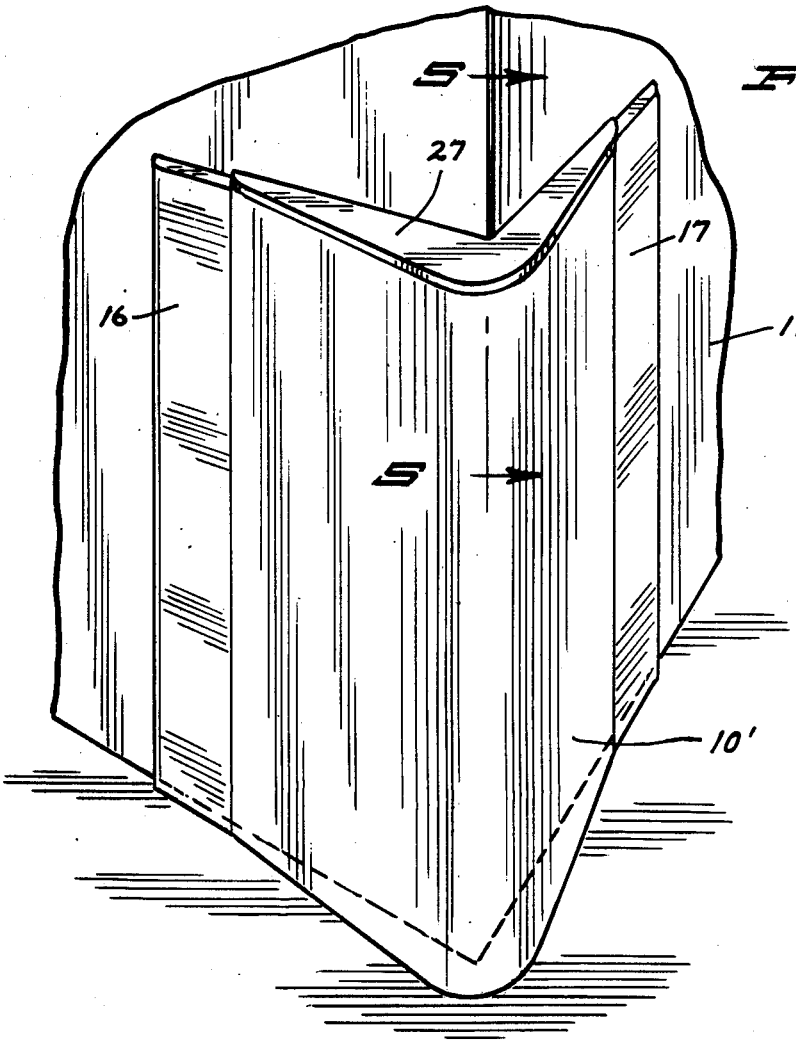
FIG. 4 is a view in perspective showing another modification.
Figure 5:
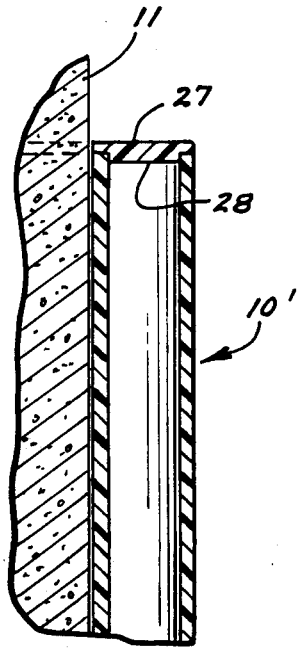
FIG. 5 is a view in vertical section taken on line 5-5 of FIG. 4 as indicated.

With respect to FIG. 4, it will be understood that the cap member 27 will be formed of a sufficiently yielding material which will not inhibit the yielding of the outer layer 14 responsive to the force of an impact.

The form of the invention of FIG. 6 functions in a like manner as above described with the outer layers 37, 39 and 44, 48 and the end wall 40 acting integrally in yielding to the impact of a vehicle. A vehicle will most often impact the guard member tangentally whereby the yielding movement of the layers 37 and 44 will be a substantially lateral movement in distributing or dissipating the effects of the impact.

The guard member as here above described is very readily installed in operation without any prior preparation of the wall surface onto which it will be applied. The simplicity of its installation and its unique unitary construction permit it to very effectively distribute or dissipate the effects of impact without damage to the underlying wall member.

It will of course be understood that various changes may be made in the form, details, arrangement and proportions of the product without departing from the scope of applicant's invention which, generally stated, consists in a product capable of carrying out the objects above set forth, such as disclosed and defined in the appended claims.

What is claimed is:

1. A unitarily formed wall member guard structure, comprising a separated body portion formed of resilient deformable material, said body portion having an underlying and an overlying layer, said layers having common side edge portions at either side of said body portion, said overlying layer diverging from the underlying layer at an acute angle from each of said common side edge portions defining a space therebetween of increasing separation, said underlying layer having a smooth unbroken underlying surface conforming to an underlying wall surface, and said overlying layer deformably yielding under impact to insulate said underlying layer and underlying wall surface from the effect of said impact,

2. The structure set forth in claim 1, wherein said underlying layer has a underlying adhesive surface.

3. The structure set forth in claim 1, including means securing said common edge portions to an underlying wall surface portion.

4. The structure set forth in claim 1, wherein said underlying and said overlying layers having spaced overlapping integral portions centrally thereof remote from said common side edge portions.

* * * * *